US006620209B2

(12) United States Patent
Kischkel et al.

(10) Patent No.: US 6,620,209 B2
(45) Date of Patent: Sep. 16, 2003

(54) LAUNDRY DETERGENT COMPOSITIONS

(75) Inventors: Ditmar Kischkel, Monheim (DE); Manfred Weuthen, Langenfeld (DE); Jutta Stute, Cologne (DE)

(73) Assignee: Cognis Deutschland GmbH & Co. KG, Duesseldorf (DE)

( * ) Notice: Subject to any disclaimer, the term of this patent is extended or adjusted under 35 U.S.C. 154(b) by 0 days.

(21) Appl. No.: 09/949,529

(22) Filed: Sep. 7, 2001

(65) Prior Publication Data

US 2002/0155981 A1 Oct. 24, 2002

(30) Foreign Application Priority Data

Sep. 8, 2000 (DE) ..... 100 44 472

(51) Int. Cl.[7] ..... D06L 1/12; C11D 1/38; C11D 3/08; C11D 3/37; C11D 7/14

(52) U.S. Cl. ..... 8/137; 510/319; 510/330; 510/334; 510/340; 510/356; 510/466; 510/475; 510/504; 510/507; 510/511; 510/515; 510/528; 510/532

(58) Field of Search ..... 510/319, 330, 510/334, 340, 356, 466, 475, 504, 507, 511, 515, 528, 532; 8/137

(56) References Cited

U.S. PATENT DOCUMENTS

| | | | | |
|---|---|---|---|---|
| 3,966,629 A | | 6/1976 | Dumbrell | 252/140 |
| 4,062,647 A | | 12/1977 | Storm et al. | 8/137 |
| 4,172,887 A | | 10/1979 | Vanlerberghe et al. | 424/70 |
| 4,524,009 A | | 6/1985 | Valenty | 252/89.1 |
| 4,639,325 A | | 1/1987 | Valenty et al. | 252/89.1 |
| 4,737,306 A | | 4/1988 | Wichelhaus et al. | 252/95 |
| 4,761,249 A | * | 8/1988 | Glede et al. | 252/528 |
| 4,816,553 A | | 3/1989 | Baur et al. | 528/245 |
| 4,820,439 A | | 4/1989 | Rieck | 252/135 |
| 4,985,553 A | | 1/1991 | Fuertes et al. | 536/124 |
| 5,002,695 A | | 3/1991 | Schulz et al. | 252/321 |
| 5,374,716 A | | 12/1994 | Biermann et al. | 536/18.6 |
| 5,382,377 A | | 1/1995 | Raehse et al. | 252/174 |
| 5,417,951 A | | 5/1995 | Just | 423/334 |
| 5,431,780 A | | 7/1995 | Raehse et al. | 159/48.1 |
| 5,494,488 A | | 2/1996 | Arnoldi et al. | 8/137 |
| 5,501,814 A | | 3/1996 | Engelskirchen et al. | 252/174.17 |
| 5,536,430 A | | 7/1996 | Fues et al. | 510/535 |
| 5,541,316 A | | 7/1996 | Engelskirchen et al. | 510/471 |
| 5,576,425 A | | 11/1996 | Hill et al. | 536/18.6 |
| 5,637,560 A | | 6/1997 | Raehse et al. | 510/443 |
| 5,780,420 A | | 7/1998 | Breuer et al. | 510/466 |
| 5,821,360 A | | 10/1998 | Engelskirchen et al. | 536/124 |
| 5,830,956 A | | 11/1998 | Stockhausen et al. | 526/318.2 |
| 5,854,321 A | | 12/1998 | Krause et al. | 524/58 |
| 5,959,101 A | | 9/1999 | Engelskirchen et al. | 536/124 |
| 6,075,001 A | | 6/2000 | Wilde | 510/376 |
| 6,153,576 A | | 11/2000 | Blum et al. | 510/311 |
| 6,187,055 B1 | | 2/2001 | Kottwitz et al. | 8/137 |
| 6,200,946 B1 | | 3/2001 | Blum et al. | 510/372 |

FOREIGN PATENT DOCUMENTS

| | | | | |
|---|---|---|---|---|
| CA | 2158714 | | 9/1995 | |
| DE | 196 16 769 | | 11/1967 | |
| DE | 2 334 899 | | 1/1974 | |
| DE | 25 53 900 | | 6/1977 | |
| DE | 42 06 050 | | 9/1983 | |
| DE | 35 26 405 | | 2/1987 | |
| DE | 0 309 931 | | 4/1989 | |
| DE | 38 16 842 | | 11/1989 | |
| DE | 40 30 688 | | 4/1992 | |
| DE | 42 04 035 | | 8/1993 | |
| DE | 42 04 090 | | 8/1993 | |
| DE | 42 06 495 | | 9/1993 | |
| DE | 42 06 521 | | 9/1993 | |
| DE | 42 08 773 | | 9/1993 | |
| DE | 42 09 432 | | 9/1993 | |
| DE | 42 21 381 | | 2/1994 | |
| DE | 42 34 376 | | 4/1994 | |
| DE | 43 00 772 | | 7/1994 | |
| DE | 43 03 320 | | 8/1994 | |
| DE | 44 00 024 | | 7/1995 | |
| DE | 44 16 438 | | 11/1995 | |
| DE | 44 17 734 | | 11/1995 | |
| DE | 44 43 177 | | 6/1996 | |
| DE | 195 29 905 | | 2/1997 | |
| DE | 195 36 082 | | 4/1997 | |
| DE | 196 00 018 | | 7/1997 | |
| DE | 196 05 688 | | 8/1997 | |
| DE | 196 13 103 | | 10/1997 | |
| DE | 196 20 411 | | 10/1997 | |
| DE | 196 16 693 | | 11/1997 | |
| DE | 196 16 767 | | 11/1997 | |
| DE | 196 16 770 | | 11/1997 | |
| DE | 196 20 267 | | 11/1997 | |
| DE | 10044472 | A1 * | 3/2002 | C11D/3/08 |
| EP | 0 026 529 | | 4/1981 | |
| EP | 0 028 432 | | 5/1981 | |
| EP | 0 150 930 | | 8/1985 | |
| EP | 0 164 514 | | 12/1985 | |
| EP | 0 232 202 | | 12/1987 | |
| EP | 0 272 030 | | 6/1988 | |

(List continued on next page.)

OTHER PUBLICATIONS

J. Falbe, "Surfactants in Consumer Products", Springer Verlag, Berlin, pp. 54–124 (1987) No month given.

J. Falbe, "Katalysatoren, Tenside und Mineraloladditive", Thieme Verlag, Stuttgart, pp. 123–217 (1978), No month given & Not translated.

R. C. Mackenzie, B.D. Mitchell, *Differential Thermal Analysis*, "The Analyst", 87 pp. 420–434 (Jun. 1962).

*Primary Examiner*—Yogendra N. Gupta
*Assistant Examiner*—Brian P. Mruk
(74) *Attorney, Agent, or Firm*—John F. Drach; Steven J. Irzaska

(57) ABSTRACT

A detergent composition comprising:

(a) a surfactant selected from the group consisting of an anionic surfactant, a nonionic surfactant, an amphoteric surfactant, a zwitterionic surfactant, and mixtures thereof;

(b) a cationic polymer; and (c) a zeolite.

18 Claims, No Drawings

FOREIGN PATENT DOCUMENTS

| | | | | |
|---|---|---|---|---|
| EP | 0 280 223 | | 8/1988 | |
| EP | 0 301 298 | | 2/1989 | |
| EP | 0 392 592 | | 10/1990 | |
| EP | 0 427 349 | | 5/1991 | |
| EP | 0 458 397 | | 11/1991 | |
| EP | 0 458 398 | | 11/1991 | |
| EP | 0 472 042 | | 2/1992 | |
| EP | 0 496 510 | | 7/1992 | |
| EP | 0 525 239 | | 2/1993 | |
| EP | 0 542 496 | | 5/1993 | |
| EP | 0 544 490 | | 6/1993 | |
| EP | 0 544 519 | | 6/1993 | |
| EP | 0 549 271 | | 6/1993 | |
| EP | 0 549 272 | | 6/1993 | |
| EP | 0 486 592 | | 6/1994 | |
| EP | 0 446 982 | | 10/1994 | |
| EP | 0 453 003 | | 10/1994 | |
| EP | 0 443 651 | | 10/1995 | |
| EP | 0 693 550 | | 1/1996 | |
| EP | 1188817 | A2 * | 3/2002 | ..... C11D/3/22 |
| FR | 2 252 840 | | 11/1974 | |
| GB | 1400898 | | 7/1975 | |
| GB | 94 19 091 | | 11/1994 | |
| JP | 93/339896 | | 12/1993 | |
| WO | WO 90/03977 | | 4/1990 | |
| WO | WO 91/08171 | | 6/1991 | |
| WO | WO 92/18542 | | 10/1992 | |
| WO | WO 93/02176 | | 2/1993 | |
| WO | WO 93/08251 | | 4/1993 | |
| WO | WO 93/16110 | | 8/1993 | |
| WO | WO 94/09111 | | 4/1994 | |
| WO | WO 94/27970 | | 12/1994 | |
| WO | WO 94/28030 | | 12/1994 | |
| WO | WO 94/28102 | | 12/1994 | |
| WO | WO94/28103 | | 12/1994 | |
| WO | WO 95/00626 | | 1/1995 | |
| WO | WO 95/07303 | | 3/1995 | |
| WO | WO 95/12619 | | 5/1995 | |
| WO | WO 95/14075 | | 5/1995 | |
| WO | WO 95/14759 | | 6/1995 | |
| WO | WO 95/17498 | | 6/1995 | |
| WO | WO 95/20029 | | 7/1995 | |
| WO | WO 95/20608 | | 8/1995 | |
| WO | WO 95/27775 | | 10/1995 | |
| WO | WO 98/12299 | | 3/1998 | |

* cited by examiner-

LAUNDRY DETERGENT COMPOSITIONS

BACKGROUND OF THE INVENTION

This invention concerns the field of laundry detergents and relates to compositions comprising a conditioning surfactant system.

Among laundry detergents available on the market are compositions which not only clean the laundry but give it a soft hand. Such compositions, sometimes known as "soft detergents", include conditioners which are generally cationic surfactants of the type of the tetraalkylammonium compounds, usually together with phyllosilicates. Since laundry detergents are customarily based on anionic surfactants, the presence of cationic surfactants tends to cause undesirable salt formation, which leads to the deactivation of a portion of the detersive components and also to deposits on the fibers. Consequently, manufacturers of soft detergents need to preserve a balance and include only as much cationic surfactant in the formulation as is possible without signficant salt formation. This amount is generally below 0.5% by weight. Given such low use concentrations, it is of course immediately clear why soft detergents have hitherto not been very successful in the marketplace and have hitherto been unable to displace liquid fabric conditioners added in the post-rinse cycle, i.e., after conclusion of the actual wash.

It is accordingly an object of the present invention to provide novel laundry detergent compositions, preferably in the form of powders, granules, extrudates or agglomerates, where the problem of salt formation between anionic and cationic surfactants has been solved, so that larger amounts of cationic surfactants may be used for the same high detergency and hence a better fiber hand finish may be achieved.

DESCRIPTION OF THE INVENTION

The invention provides laundry detergent compositions including (a) anionic surfactants, nonionic and/or amphoteric surfactants, (b) cationic polymers, (c) phosphates and optionally (d) phyllosilicates, wherein component (b) is preferably present in amounts from 1 to 20%, preferably from 2 to 15%, especially from 3 to 10%, particularly preferably from 4 to 8%, by weight.

The laundry detergent compositions of the invention surprisingly meet the aforementioned requirements in an excellent manner. Combined with nonionic and/or amphoteric surfactants, the cationic polymers not only exhibit an improved soft hand but also a reduced tendency to form salts with anionic surfactants, which makes it possible to manufacture laundry detergent compositions having a higher cationic surfactant content than the prior art. In addition, the combination with phosphate builders provides a particularly advantageous conditioning effect which may be improved still further by the addition of phyllosilicates and/or by using a surfactant system which is free of anionics and is based on nonionic and/or amphoteric surfactants, specifically alk(en)yl oligoglycosides and/or betaines.

Anionic Surfactants

The laundry detergents may comprise as component (a) anionic, nonionic and/or amphoteric or zwitterionic surfactants; preferably, however, anionic surfactants or combinations of anionic and nonionic surfactants are present. Typical examples of anionic surfactants are soaps, alkylbenzenesulfonates, alkanesulfonates, olefinsulfonates, alkyl ether sulfonates, glycerol ether sulfonates, α-methyl ester sulfonates, sulfo fatty acids, alkyl sulfates, fatty alcohol ether sulfates, glycerol ether sulfates, hydroxy-mixed ether sulfates, monoglyceride (ether) sulfates, fatty acid amide (ether) sulfates, mono- and dialkyl sulfo-succinates, mono-and dialkyl sulfosuccinamates, sulfotriglycerides, amide soaps, ether carboxylic acids and salts thereof, fatty acid isethionates, fatty acid sarcosinates, fatty acid taurides, N-acyl amino acids such as, for example, acyl lactylates, acyl tartrates, acyl glutamates and acyl aspartates, alkyl oligo-glucoside sulfates, protein fatty acid condensates (especially plant products based on wheat), and alkyl (ether) phosphates. Where the anionic surfactants contain polyglycol ether chains, these chains may have a conventional or, preferably, a narrowed homolog distribution. Preference is given to using alkylbenzenesulfonates, alkyl sulfates, soaps, alkane-sulfonates, olefinsulfonates, methyl ester sulfonates, and mixtures thereof.

Alkylbenzenesulfonates

Preferred alkylbenzenesulfonates conform preferably to the formula (I)

$$R\text{-}Ph\text{-}SO_3X \quad (I)$$

in which R is a branched or, preferably, a linear alkyl radical having from 10 to 18 carbon atoms, Ph is a phenyl radical, and X is an alkali metal and/or alkaline earth metal, ammonium, alkylammonium, alkanolammonium or glucammonium. Of these, particular suitability is possessed by dodecyl-benzenesulfonates, tetradecylbenzenesulfonates, hexadecylbenzenesulfonates, and their technical-grade mixtures in the form of sodium salts.

Alkyl and/or Alkenyl Sulfates

Alkyl and/or alkenyl sulfates, frequently also referred to as fatty alcohol sulfates, are the sulfation products of primary and/or secondary alcohols, conforming preferably to the formula (II)

$$R^2O\text{-}SO_3Y \quad (II)$$

in which $R^2$ is a linear or branched, aliphatic alkyl and/or alkenyl radical having from 6 to 22, preferably from 12 to 18 carbon atoms, and Y is an alkali metal and/or alkaline earth metal, ammonium, alkylammonium, alkanolammonium or glucammonium. Typical examples of alkyl sulfates that may be used in the context of the invention are the sulfation products of caproyl alcohol, caprylyl alcohol, capryl alcohol, 2-ethylhexyl alcohol, lauryl alcohol, myristyl alcohol, cetyl alcohol, palmoleyl alcohol, stearyl alcohol, isostearyl alcohol, oleyl alcohol, elaidyl alcohol, petroselinyl alcohol, arachyl alcohol, gadoleyl alcohol, behenyl alcohol, and erucyl alcohol, and their technical mixtures obtained by high-pressure hydrogenation of industrial methyl ester fractions or aldehydes from the Roelen oxo synthesis. The sulfation products may be used preferably in the form of their alkali metal salts and in particular of their sodium salts. Particular preference is given to alkyl sulfates based on $C_{16/18}$ tallow fatty alcohols or vegetable fatty alcohols of comparable C-chain distribution in the form of their sodium salts. In the case of branched primary alcohols, the compounds in question are oxo alcohols, as obtainable, for example, by reacting carbon monoxide and hydrogen with alpha-olefins by the Shop process. Such alcohol mixtures are available commercially under the trade names DOBANOL® or NEODOL®. Suitable alcohol mixtures are DOBANOL 91®, 23®, 25®, and 45®. A further possibility are oxo alcohols such as are obtained by the classic oxo process of Enichema or of Condea by addition reaction of carbon monoxide and hydrogen with olefins. These alcohol mixtures comprise a mixture of highly branched alcohols. Such alcohol mixtures are available commercially under the trade name LIAL®. Suitable alcohol mixtures are Lial 91®, 111, 123®, 125®, and 145®.

Soaps

Soaps, finally, are fatty acid salts of the formula (III)

$$R^3CO\text{-}OX \quad (III)$$

in which $R^3CO$ is a linear or branched, saturated or unsaturated acyl radical having from 6 to 22 and preferably from 12 to 18 carbon atoms, and X is alkali metal and/or alkaline earth metal, ammonium, alkylammonium or alkanolammonium. Typical examples are the sodium, potassium, magnesium, ammonium and triethanolammonium salts of caproic acid, caprylic acid, 2-ethylhexanoic acid, capric acid, lauric acid, isotridecanoic acid, myristic acid, palmitic acid, palmoleic acid, stearic acid, isostearic acid, oleic acid, elaidic acid, petroselinic acid, linoleic acid, linolenic acid, eleostearic acid, arachinic acid, gadoleic acid, behenic acid, and erucic acid, and also their technical-grade mixtures. Preference is given to using coconut or palm kernel fatty acid in the form of their sodium or potassium salts.

Nonionic Surfactants

Typical examples of nonionic surfactants are fatty alcohol polyglycol ethers, alkylphenol polyglycol ethers, fatty acid polyglycol esters, fatty amide polyglycol ethers, fatty amine polyglycol ethers, alkoxylated triglycerides, mixed ethers and mixed formals, alk(en)yl oligoglycosides, fatty acid N-alkylglucamides, protein hydrolysates (especially plant products based on wheat), polyol fatty acid esters, sugar esters, sorbitan esters, polysorbates and amine oxides. Where the nonionic surfactants contain polyglycol ether chains, these chains may have a conventional or, preferably, a narrowed homolog distribution. Preference is given to using fatty alcohol polyglycol ethers, alkoxylated fatty acid lower alkyl esters or alkyl oligoglucosides.

Fatty Alcohol Polyglycol Ethers

The preferred fatty alcohol polyglycol ethers conform to the formula (IV)

$$R^4O(CH_2CHR^5O)_nH \quad (IV)$$

in which $R^4$ is a linear or branched alkyl and/or alkenyl radical having from 6 to 22, preferably from 12 to 18 carbon atoms, $R^5$ is hydrogen or methyl, and n stands for numbers from 1 to 20. Typical examples are the adducts of on average from 1 to 20 and preferably from 5 to 10 mol of ethylene oxide and/or propylene oxide with caproyl alcohol, caprylyl alcohol, 2-ethylhexyl alcohol, capryl alcohol, lauryl alcohol, isotridecyl alcohol, myristyl alcohol, cetyl alcohol, palmoleyl alcohol, stearyl alcohol, isostearyl alcohol, oleyl alcohol, elaidyl alcohol, petroselinyl alcohol, linolyl alcohol, linolenyl alcohol, eleostearyl alcohol, arachyl alcohol, gadoleyl alcohol, behenyl alcohol, erucyl alcohol, and brassidyl alcohol, and their technical-grade mixtures. Particular preference is given to adducts of 3, 5 or 7 mol of ethylene oxide with technical-grade coconut fatty alcohols.

Alkoxylated Fatty Acid Lower Alkyl Esters

Suitable alkoxylated fatty acid lower alkyl esters include surfactants of the formula (V)

$$R^6CO(OCH_2CHR^7)_mOR^8 \quad (V)$$

in which R CO is a linear or branched, saturated and/or unsaturated acyl radical having from 6 to 22 carbon atoms, $R^7$ is hydrogen or methyl, $R^8$ is linear or branched alkyl radicals having from 1 to 4 carbon atoms, and m stands for numbers from 1 to 20. Typical examples are the formal insertion products of on average from 1 to 20 and preferably from 5 to 10 mol of ethylene oxide and/or propylene oxide into the methyl, ethyl, propyl, isopropyl, butyl, and tert-butyl esters of caproic acid, caprylic acid, 2-ethylhexanoic acid, capric acid, lauric acid, isotridecanoic acid, myristic acid, palmitic acid, palmoleic acid, stearic acid, isostearic acid, oleic acid, elaidic acid, petroselinic acid, linoleic acid, linolenic acid, eleostearic acid, arachic acid, gadoleic acid, behenic acid, and erucic acid, and their technical-grade mixtures. The products are normally prepared by inserting the alkylene oxides into the carbonyl ester linkage in the presence of special catalysts, such as calcined hydrotalcite, for example. Particular preference is given to reaction products of on average from 5 to 10 mol of ethylene oxide into the ester linkage of technical-grade coconut fatty acid methyl esters.

Alkyl and/or Alkenyl Oligoglycosides

Alkyl and alkenyl oligoglycosides, which are likewise preferred nonionic surfactants, normally conform to the formula (VI)

$$R^9O[G]p \quad (VI)$$

in which $R^9$ is an alkyl and/or alkenyl radical having from 4 to 22 carbon atoms, G is a sugar radical having 5 or 6 carbon atoms, and p stands for numbers from 1 to 10. They may be obtained by the relevant processes of preparative organic chemistry. As representatives of the extensive literature, reference may be made here to the documents EP 0301298 A1 and WO 90/03977. The alkyl and/or alkenyl oligoglycosides may derive from aldoses and/or ketoses having 5 or 6 carbon atoms, preferably from glucose. The preferred alkyl and/or alkenyl oligoglycosides are therefore alkyl and/or alkenyl oligoglucosides. The index p in the general formula (VI) indicates the degree of oligomerization (DP), i.e., the distribution of monoglycosides and oligoglycosides, and stands for a number between 1 and 10. While p in a given compound must always be integral and in this case may adopt in particular the values p=1 to 6, p for a particular alkyl oligoglycoside is an analytically determined arithmetic variable which usually represents a fraction. Preference is given to using alkyl and/or alkenyl oligoglycosides having an average degree of oligomerization p of from 1.1 to 3.0. From a performance standpoint, preference is given to alkyl and/or alkenyl oligoglycosides whose degree of oligomerization is less than 1.7 and is in particular between 1.2 and 1.4. The alkyl and/or alkenyl radical $R^9$ may derive from primary alcohols having from 4 to 11, preferably from 8 to 10 carbon atoms. Typical examples are butanol, caproyl alcohol, caprylyl alcohol, capryl alcohol, and undecyl alcohol, and their technical-grade mixtures, as obtained, for example, in the hydrogenation of technical-grade fatty acid methyl esters or in the course of the hydrogenation of aldehydes from the Roelen oxo process. Preference is given to alkyl oligoglucosides of chain length $C_8$–$C_{10}$ (DP=1 to 3), which are obtained as the initial fraction during the distillative separation of technical-grade $C_8$–$C_{18}$ coconut fatty alcohol and may have an impurities fraction of less than 6% by weight of $C_{12}$ alcohol, and also alkyl oligoglucosides based on technical-grade $C_{9/11}$ oxo alcohols (DP=1 to 3). The alkyl and/or alkenyl radical $R^9$ may also derive from primary alcohols having from 12 to 22, preferably from 12 to 14 carbon atoms. Typical examples are lauryl alcohol, myristyl alcohol, cetyl alcohol, palmoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol, brassidyl alcohol, and their technical-grade mixtures, which may be obtained as described above. Preference is given to alkyl oligoglucosides based on hydrogenated $C_{12/14}$ cocoyl alcohol with a DP of from 1 to 3.

Amphoteric or Zwitterionic Surfactants

Typical examples of amphoteric or zwitterionic surfactants are alkyl betaines, alkylamido betaines, aminopropionates, aminoglycinates, imidazolinium betaines and sulfo betaines. The aforementioned surfactants exclusively comprise known compounds. With regard to the structure and preparation of these substances, reference may be made to relevant review works; for example, J. Falbe (ed.), "Surfactants in Consumer Products", Springer Verlag, Berlin, 1987, pp. 54–124 or J. Falbe (ed.), "Katalysatoren, Tenside und Mineraloladditive", Thieme Verlag, Stuttgart, 1978, pp. 123–217.

The laundry detergents may comprise the anionic, nonionic and/or amphoteric or zwitterionic surfactants in amounts from 1 to 50%, preferably from 5 to 25%, in particular from 10 to 20%, by weight, based on the laundry detergents.

Cationic Polymers

Cationic polymers suitable as component (b) are, for example, cationic cellulose derivatives, such as a quaternized hydroxyethylcellulose which is obtainable under the designation Polymer JR 400® from Amerchol, cationic starch, copolymers of diallylammonium salts and acrylamides, quaternized vinylpyrrolidone/vinyl-imidazole polymers, such as LUVIQUAT® (BASF), condensation products of polyglycols and amines, quaternized collagen polypeptides, such as Lauryl-dimonium Hydroxypropyl Hydrolyzed Collagen (LAMEQUAT® L/Grünau), for example, quaternized wheat polypeptides, polyethyleneimine, cationic silicone polymers, such as amodimethicones, for example, copolymers of adipic acid and dimethylaminohydroxy-propyldiethylenetriamine (CARTARETINE®/Sandoz), copolymers of acrylic acid with dimethyldiallylammonium chloride (MERQUAT® 550/Chemviron), polyaminopolyamides, as described, for example, in FR 2252840 A, and cross-linked water-soluble polymers thereof, cationic chitin derivatives such as quaternized chitosan, for example, divided into microcrystalline form where appropriate, condensation products of dihaloalkylene, such as dibromobutane, with bisdialkylamines, such as 1,3-bis-dimethylaminopropane, quaternized ammonium salt polymers, such as MIRAPOL® A-15, MIRAPOL® AD-1, and MIRAPOL® AZ-1 from Miranol, and also, in particular, cationic guar gum, also known as guar hydroxypropyl-trimethylammonium chloride, such as JAGUAR® CBS, JAGUAR® C-17, and JAGUAR® C-16 from Celanese or COSMEDIA® guar from Cognis.

The compositions of the invention may comprise the cationic polymers in amounts of from 0.1 to 10%, preferably from 1 to 8%, in particular from 3 to 5%, by weight, based on the compositions.

Zeolites

The finely crystalline, synthetic zeolite containing bound water that is frequently used as a laundry detergent builder is preferably zeolite A and/or P. An example of the particularly preferred zeolite P is zeolite MAP® (commercial product from Crosfield). Also suitable, however, are zeolite X and also mixtures of A, X and/or P and also Y. Also of particular interest is a cocrystallized sodium/potassium aluminum silicate comprising zeolite A and zeolite X, which is available commercially as VEGOBOND AX® (commercial product from Condea Augusta S.p.A. The zeolite maybe employed in the form of spray-dried powder or else as an undried (still wet from its preparation), stabilized suspension. Where the zeolite is used in suspension form, said suspension may include small additions of nonionic surfactants as stabilizers: for example, from 1 to 3% by weight, based op zeolite, of ethoxylated $C_{12}$–$C_{18}$ fatty alcohols having from 2 to 5 ethylene oxide groups, $C_{12}$–$C_{18}$ fatty alcohols having from 4 to 5 ethylene oxide groups or ethoxylated isotridecanols. Suitable zeolites have an average particle size of less than 10 $\mu$m (volume distribution; measurement method: Coulter counter) and contain preferably from 18 to 22% by weight, in particular from 20 to 22% by weight, of bound water. The zeolites are preferably present in the final formulations in amounts from 10 to 60%, preferably from 20 to 40%, especially 15 to 25% by weight, based on the compositions.

Phyllosilicates

As optional component (d) the compositions may further comprise phyllosilicates or bentonites. Typical examples are crystalline, layered sodium silicates of the general formula $NaMSi_xO_{2x+1}.yH_2O$, where M is sodium or hydrogen, x is a number from 1.9 to 4, y is a number from 0 to 20, and preferred values for x are 2, 3 or 4. Crystalline phyllosilicates of this kind are described, for example, in the European patent application EP 0164514 A1. Preferred crystalline phyllosilicates of the formula indicated are those in which M is sodium and x adopts the value 2 or 3. In particular, both β-and and δ-sodium disilicates $Na_2Si_2O_5.yH_2O$ are preferred, β-sodium disilicate, for example, being obtainable by the process described in the international patent application WO 91/08171. Further suitable phyllosilicates are known, for example, from the patent applications DE 2334899 A1, EP 0026529 A1 and DE 3526405 A1. Their usefulness is not restricted to a specific composition or structural formula. However, preference is given here to smectites, especially bentonites. Suitable phyllosilicates which belong to the group of the water-swellable smectites include, for example, those of the general formulae $(OH)_4Si_8\text{-}yAl_y(Mg_xAl_{4-x})O_{20}$ montmorillonite $(OH)_4Si_8\text{-}yAl_y(Mg_{6-z}Li_z)O_{20}$ hectorite $(OH)_4Si_8\text{-}yAl_y(Mg_{6-z}Al_z)O_{20}$ saponite where x=0 to 4, y=0 to 2, z=0 to 6. Moreover, small amounts of iron may be incorporated into the crystal lattice of the phyllosilicates in accordance with the above formulae. Moreover, on the basis of their ion exchange properties, the phyllosilicates may contain hydrogen, alkali metal and/or alkaline earth metal ions, especially $Na^+$and $Ca^{2+}$. The amount of water in hydrate form is generally in the range from 8 to 20% by weight and is dependent on the state of swelling and/or on the nature of processing. Phyllosilicates which can be used are known, for example, from U.S. Pat. No. 3,966,629, U.S. Pat. No. 4,062,647, EP 0026529 A1 and EP 0028432 A1. It is preferred to use phyllosilicates which owing to an alkali treatment are substantially free of calcium ions and strongly coloring iron ions.

Alternatively, it is also possible to use amorphous sodium silicates having an $Na_2O:SiO_2$ modulus of from 1:2 to 1:3.3, preferably from 1:2 to 1:2.8, and in particular from 1:2 to 1:2.6, which are dissolution-retarded and have secondary washing properties. The retardation of dissolution relative to conventional amorphous sodium silicates may have been brought about in a variety of ways, for example, by surface treatment, compounding, compacting, or overdrying. In the context of this invention, the term "amorphous" also embraces "X-ray-amorphous". This means that, in X-ray diffraction experiments, the silicates do not yield the sharp X-ray reflections typical of crystalline substances but instead yield at best one or more maxima of the scattered X-radiation, having a width of several degree units of the diffraction angle. However, good builder properties may result, even particularly good builder properties, if the silicate particles in electron diffraction experiments yield vague or even sharp diffraction maxima. The interpretation of this is that the products have microcrystalline regions with a size of from 10 to several hundred nm, values up to max. 50 nm and in particular up to max. 20 nm being preferred. So-called X-ray-amorphous silicates of this kind, which likewise possess retarded dissolution relative to the conventional waterglasses, are described, for example, in the German patent application DE 4400024 A1. Particular preference is given to compact amorphous silicates, compounded amorphous silicates, and overdried X-ray-amorphous silicates.

Based on the compositions, the phyllosilicates may be present in amounts from 1 to 10%, preferably from 3 to 8%, by weight.

Builders

Further preferred ingredients of the laundry detergents of the invention are additional organic and inorganic builder substances, with phosphates being employed primarily as inorganic builder substances. The amount of cobuilder should be included within the preferred amounts of zeolites.

Phosphates

Suitable are in particular the sodium salts of orthophosphates, of pyrophosphates and especially of tripolyphosphates. The phosphates are present in the final formulations preferably in amounts from 10 to 60%, especially 20 to 40%, by weight, based on the compositions.

Poly-and Hydroxycarboxylic Acids

Organic builder substances which may be used are, for example, the polycarboxylic acids that can be used in the form of their sodium salts, such as citric acid, adipic acid, succinic acid, glutaric acid, tartaric acid, sugar acids, aminocarboxylic acids, nitrilotriacetic acid (NTA), if such a use is acceptable on ecological grounds, and mixtures thereof. Preferred salts are the salts of polycar-boxylic acids such as citric acid, adipic acid, succinic acid, glutaric acid, tartaric acid, sugar acids and mixtures thereof. The acids per se may also be used. In addition to their builder effect, the acids typically also possess the property of an acidifying component and thus also serve to establish a lower and milder pH in laundry detergents or cleaning products. In this context, mention may be made in particular of citric acid, succinic acid, glutaric acid, adipic acid, gluconic acid, and any desired mixtures of these.

Further organic cobuilders which can be used are, for example, acetylated hydroxycarboxylic acids and/or their salts, which may also be present, where appropriate, in lactone form and which contain at least 4 carbon atoms and at least one hydroxyl group and also not more than two acid groups. Cobuilders of this kind are described, for example, in the international patent application WO 95/20029.

Polymeric Polycarboxylates

Suitable polymeric polycarboxylates are, for example, the sodium salts of polyacrylic acid or of polymethacrylic acid, examples being those having a relative molecular mass of from 800 to 150 000 (based on acid and in each case measured against polystyrenesulfonic acid). Particularly suitable copolymeric polycarboxylates are those of acrylic acid with methacrylic acid and of acrylic acid or methacrylic acid with maleic acid. Copolymers of acrylic acid with maleic acid, containing from 50 to 90% by weight acrylic acid and from 50 to 10% by weight maleic acid, have proven particularly suitable. Their relative molecular mass, based on free acids, is generally from 5 000 to 200 000, preferably from 10 000 to 120 000, and in particular from 50 000 to 100 000 (measured in each case against polystyrenesulfonic acid). The (co)polymeric polycarboxylates may be used either as powders or in the form of an aqueous solution, in which case preference is given to aqueous solutions with a strength of from 20 to 55% by weight. Granular polymers are generally admixed subsequently to one or more base granules. Particular preference is also given to biodegradable polymers made up of more than two different monomer units, examples being those in accordance with DE 4300772 A1, containing as monomers salts of acrylic acid and of maleic acid and also vinyl alcohol and/or vinyl alcohol derivatives, or those in accordance with DE 4221381 C2, containing as monomers salts of acrylic acid and of 2-alkylallylsulfonic acid and also sugar derivatives. Preferred also as copolymers are those which are described in the German patent applications DE 4303320 A1 and DE 4417734 A1 and whose monomers comprise preferably acrolein and acrylic acid/acrylic acid salts or acrolein and vinyl acetate. Further preferred builder substances include polymeric amino dicarboxylic acids, their salts or their precursors. Particular preference is given to polyaspartic acids and their salts and derivatives.

Polyacetals

Further suitable builder substances are polyacetals, which may be obtained by reacting dialdehydes with polyolcarboxylic acids having from 5 to 7 carbon atoms and at least 3 hydroxyl groups, as described for example in the European patent application EP 0280223 A1. Preferred polyacetals are obtained from dialdehydes such as glyoxal, glutaraldehyde, terephthalaldehyde and mixtures thereof and from polyolcarboxylic acids such as gluconic acid and/or glucoheptonic acid.

Dextrins

Further suitable organic builder substances are dextrins, examples being oligomers and polymers of carbohydrates, which may be obtained by partial hydrolysis of starches. The hydrolysis may be conducted by customary processes, examples being acid-catalyzed or enzyme-catalyzed processes. The hydrolysis products preferably have average molar masses in the range from 400 to 500 000. Preference is given here to a polysaccharide having a dextrose equivalent (DE) in the range from 0.5 to 40, in particular from 2 to 30, DE being a common measure of the reducing effect of a polysaccharide in comparison to dextrose, which possesses a DE of 100. It is possible to use both maltodextrins having a DE of between 3 and 20 and dry glucose syrups having a DE of between 20 and 37, and also so-called yellow dextrins and white dextrins having higher molar masses, in the range from 2 000 to 30 000. One preferred dextrin is described in the British patent application GB 9419091 A1. The oxidized derivatives of such dextrins comprise their products of reaction with oxidizing agents which are able to oxidize at least one alcohol function of the saccharide ring to the carboxylic acid function. Oxidized dextrins of this kind, and processes for preparing them, are known, for example, from the European patent applications EP 0232202 A1, EP 0427349 A1, EP 0472042 A1 and EP 0542496 A1 and from the international patent applications WO 92/18542, WO 93/08251, WO 93/16110, WO 94/28030, WO 95/07303, WO 95/12619 and WO 95/20608. Likewise suitable is an oxidized oligosaccharide in accordance with the German patent application DE 19600018 A1. A product oxidized at $C_6$ of the saccharide ring may be particularly advantageous.

Disuccinates

Further suitable cobuilders are oxydisuccinates and other derivatives of disuccinates, preferably ethylenediamine disuccinate. Particular preference is given in this context as well to glycerol disuccinates and glycerol trisuccinates, as described for example in the U.S. patents U.S. Pat. No. 4,524,009, U.S. Pat. No. 4,639,325, in the European patent application EP 0150930 A1 and in the Japanese patent application JP 93/339896. Suitable use amounts in formulations containing zeolite and/or silicate are from 3 to 15% by weight.

Fat-and Oil-Detaching Components

In addition, the compositions may also comprise components which have a positive influence on the ease with which oil and fat are washed off from textiles. The preferred oil-and fat-detaching components include, for example, nonionic cellulose ethers such as methylcellulose and methylhydroxypropylcellulose having a methoxy group content of from 15 to 30% by weight and a hydroxypropoxy group content of from 1 to 15% by weight, based in each case on the nonionic cellulose ether, and also the prior art polymers of phthalic acid and/or of terephthalic acid and/or of derivatives thereof, especially polymers of ethylene terephthalates and/or polyethylene glycol terephthalates, or anionically and/or nonionically modified derivatives thereof. Of these, particular preference is given to the sulfonated derivatives of the phthalic acid polymers and of the terephthalic acid polymers.

Bleaches

Among the compounds used as bleaches which yield $H_2O_2$ in water, particular importance is possessed by sodium perborate tetrahydrate and sodium perborate mono-hydrate. Further bleaches which may be used are, for example, sodium percarbonate, peroxypyrophosphates, citrate perhydrates, and $H_2O_2$-donating peracidic salts or peracids, such as perbenzoates, peroxophthalates, diperazelaic acid, phthaliminoperoxy acid or diperdo-decanedioic acid. The bleach content of the compositions is preferably from 5 to 35% by weight and in particular up to 30% by weight, use being made advantageously of perborate monohydrate or percarbonate.

Bleach Activators

Bleach activators which may be used are compounds which under perhydrolysis conditions give rise to aliphatic peroxocarboxylic acids having preferably from 1 to 10 carbon atoms, in particular from 2 to 4 carbon atoms, and/or unsubstituted or substituted perbenzoic acid. Suitable substances are those which carry O-acyl and/or N-acyl groups of the stated number of carbon atoms, and/or substituted or unsubstituted benzoyl groups. Preference is given to polyacylated alkylenediamines, especially tetraacetylethylenediamine (TAED), acylated triazine derivatives, especially 1,5-diacetyl-2,4-dioxohexahydro-1,3,5-triazine (DADHT), acylated glycolurils, especially tetraacetylglycoluril (TAGU), N-acyl imides, especially N-nonanoylsuccinimide (NOSI), acylated phenolsulfonates, especially n-nonanoyl- or isononanoyloxybenzenesulfonate (n-or iso-NOBS), carboxylic anhydrides, especially phthalic anhydride, acylated polyhydric alcohols, especially triacetin, ethylene glycol diacetate, 2,5-diacetoxy-2,5-dihydrofuran, and the enol esters known from the German patent applications DE 19616693 A1 and DE 19616767 A1, and also acetylated sorbitol and mannitol and/or mixtures thereof (SORMAN) described in the European patent application EP 0525239 A1, acylated sugar derivatives, especially pentaacetylglucose (PAG), pentaacetylfructose, tetraacetylxylose and octaacetyllactose, and also acetylated, optionally N-alkylated glucamine and gluconolactone, and/or N-acylated lactams, an example being N-benzoyl caprolactam, which are known from the international patent applications WO 94/27970, WO 94/28102, WO 94/28103, WO 95/00626, WO 95/14759 and WO 95/17498. The hydrophilically substituted acyl acetals known from the German patent application DE 19616769 A1 and the acyl lactams described in the German patent application DE 19616770 and also in the international patent application WO 95/14075 are likewise used with preference. It is also possible to use the combinations of conventional bleach activators known from the German patent application DE 4443177 A1. Bleach activators of this kind are present in the customary quantity range, preferably in amounts of from 1% by weight to 10% by weight, in particular from 2% by weight to 8% by weight, based on overall composition. In addition to the abovementioned conventional bleach activators, or instead of them, it is also possible for the bleach-boosting transition metal salts and/or transition metal complexes and/or sulfone imines known from the European patents EP 0446982 B1 and EP 0453003 B1 to be present as so-called bleaching catalysts. The transition metal compounds in question include in particular those manganese, iron, cobalt, ruthenium or molybdenum salen complexes known from the German patent application DE 19529905 A1, and their N-analog compounds known from the German patent application DE 19620267 A1; the manganese, iron, cobalt, ruthenium or molybdenum carbonyl complexes known from the German patent application DE 19536082 A1; the manganese, iron, cobalt, ruthenium, molybdenum, titanium, vanadium and copper complexes with nitrogen-containing tripod ligands that are described in the German patent application DE 19605688; the cobalt, iron, copper and ruthenium amine complexes known from the German patent application DE 19620411 A1; the manganese, copper and cobalt complexes described in the German patent application DE 4416438 A1; the cobalt complexes described in the European patent application EP 0272030 A1; the manganese complexes known from the European patent application EP 0693550 A1; the manganese, iron, cobalt and copper complexes known from the European patent EP 0392592 A1; and/or the manganese complexes described in the European patent EP 0443651 B1 or in the European patent applications EP 0458397 A1, EP 0458398 A1, EP 0549271 A1, EP 0549272 A1, EP 0544490 A1 and EP 0544519 A1. Combinations of bleach activators and transition metal bleaching catalysts are known, for example, from the German patent application DE 19613103 A1 and from the international patent application WO 95/27775. Bleach-boosting transition metal complexes, especially those with the central atoms Mn, Fe, Co, Cu, Mo, V, Ti and/or Ru, are employed in customary amounts, preferably in an amount of up to 1% by weight, in particular from 0.0025% by weight to 0.25% by weight, and with particular preference from 0.01% by weight to 0.1% by weight, based in each case on overall composition.

Enzymes

Particularly suitable enzymes include those from the class of the hydrolases, such as the proteases, esterases, lipases or lipolytic enzymes, amylases, cellulases or other glycosyl hydrolases, and mixtures of the stated enzymes. A1 l of these hydrolases contribute in the wash to removing stains, such as proteinaceous, fatty or starchy stains, and instances of graying. Cellulases and other glycosyl hydrolases may, by removing pilling and microfibrils, make a contribution to color retention and to enhancing the softness of the textile. For bleaching and/or for inhibiting dye transfer it is also possible to use oxidoreductases. Especially suitable active enzymatic substances are those obtained from bacterial strains or fungi, such as *Bacillus subtilis, Bacillus licheniformis, Streptomyces griseus* and *Humicola insolens*. It is preferred to use proteases of the *subtilisin* type, and especially proteases obtained from *Bacillus lentus*. Of particular interest in this context are enzyme mixtures, examples being those of protease and amylase or protease and lipase or lipolytic enzymes, or protease and cellulase, or of cellulase and lipase or lipolytic enzymes, or of protease, amylase and lipase or lipolytic enzymes, or protease, lipase or lipolytic enzymes and cellulase, but especially mixtures containing protease and/or lipase, or mixtures containing lipolytic enzymes. Examples of such lipolytic enzymes are the known cutinases. Peroxidases or oxidases have also proven suitable in some cases. The suitable amylases include, in particular, α-amylases, iso-amylases, pullulanases, and pectinases. Cellulases used are preferably cellobiohydrolases, endoglucanases and β-glucosidases, also referred to as cellobiases, and mixtures of these. Since the different cellulase types differ in their CMCase and Avicelase activities, the desired activities may be established by means of particular mixtures of the cellulases.

The enzymes may be adsorbed on carrier substances and/or embedded in coating substances in order to protect them against premature decomposition. The fraction of the enzymes, enzyme mixtures or enzyme granules may be, for example, from about 0.1 to 5% by weight, preferably from 0.1 to about 2% by weight.

Enzyme Stabilizers

In addition to the monofunctional and polyfunctional alcohols, the compositions may comprise further enzyme stabilizers. For example, from 0.5 to 1% by weight of sodium formate may be used. Also possible is the use of proteases stabilized with soluble calcium salts, with a calcium content of preferably about 1.2% by weight, based on the enzyme. Besides calcium salts, magnesium salts also serve as stabilizers. However, it is particularly advantageous to employ boron compounds, examples being boric acid, boron oxide, borax and other alkali metal borates such as the salts of orthoboric acid ($H_3BO_3$), of metaboric acid ($HBO_2$), and of pyroboric acid (tetraboric acid, $H_2B_4O_7$).

Graying Inhibitors

Graying inhibitors (antiredeposition agents) have the function of keeping the soil detached from the fiber in suspension in the liquor and so preventing the reattachment (redeposition) of the soil. Suitable for this purpose are water-soluble colloids, usually organic in nature, examples being the water-soluble salts of polymeric carboxylic acids, glue, gelatin, salts of ether carboxylic acids or ether sulfonic acids of starch or of cellulose, or salts of acidic sulfuric esters of cellulose or of starch. Water-soluble polyamides containing acidic groups are also suitable for this purpose. Furthermore, use may be made of soluble starch preparations and starch products other than those mentioned above, examples being degraded starch, aldehyde starches, etc. Polyvinylpyrrolidone as well can be used. However, it is preferred to use cellulose ethers, such as carboxymethylcellulose (Na salt), methylcellulose, hydroxyalkylcellulose, and mixed ethers, such as methylhydroxyethylcellulose, methylhydroxypropylcellulose, methylcarboxymethylcellulose and mixtures thereof, and also polyvinylpyrrolidone, for example, in amounts of from 0.1 to 5% by weight, based on the compositions.

Optical Brighteners

As optical brighteners the compositions may comprise derivatives of diaminostilbenedisulfonic acid and/or alkali metal salts thereof. Suitable, for example, are salts of 4,4'-bis(2-anilino-4-morpholino-1,3,5-triazinyl-6-amino) stilbene-2,2'-disulfonic acid or compounds of similar structure which instead of the morpholino group carry a diethanolamino group, a methylamino group, an anilino group, or a 2-methoxyethylamino group. It is further possible for brighteners of the substituted diphenylstyryl type to be present, examples being the alkali metal salts of 4,4'-bis(2-sulfostyryl)biphenyl, 4,4'-bis(4-chloro-3-sulfostyryl) biphenyl or 4-(4-chlorostyryl)-4'-(2-sulfo-styryl)biphenyl. Mixtures of the aforementioned brighteners may also be used. Uniformly white granules are obtained if, in addition to the customary brighteners in customary amounts, examples being between 0.1 and 0.5% by weight, preferably between 0.1 and 0.3% by weight, the compositions also include small amounts, examples being from $10^{-6}$ to $10^{-3}$% by weight, preferably around $10^{-5}$% by weight, of a blue dye. One particularly preferred dye is TINOLUX® (commercial product from Ciba-Geigy).

Soil Repellents

Suitable dirt-repelling polymers (soil repellents) include those substances which preferably contain ethylene terephthalate and/or polyethylene glycol terephthalate groups, it being possible for the molar ratio of ethylene terephthalate to polyethylene glycol terephthalate to be situated within the range from 50:50 to 90:10. The molecular weight of the linking polyethylene glycol units is situated in particular in the range from 750 to 5 000, i.e., the degree of ethoxylation of the polymers containing polyethylene glycol groups can be from about 15 to 100. The polymers feature an average molecular weight of about 5 000 to 200 000 and may have a block structure, though preferably have a random structure. Preferred polymers are those having ethylene terephthalate/polyethylene glycol terephthalate molar ratios of from about 65:35 to about 90:10, preferably from about 70:30 to 80:20. Preference is also given to those polymers which have linking polyethylene glycol units with a molecular weight of from 750 to 5 000, preferably from 1 000 to about 3 000, and with a molecular weight of the polymer of from about 10 000 to about 50 000. Examples of commercial polymers are the products MILEASE® T (ICI) or REPELOTEX® SRP 3 (Rhône-Poulenc).

Defoamers

As defoamers it is possible to use waxlike compounds. "Waxlike" compounds are those whose melting point at atmospheric pressure is more than 25° C. (room temperature), preferably more than 50° C., and in particular more than 70° C. The waxlike defoamer substances are virtually insoluble in water; that is, at 20° C. they have a solubility in 100 g of water of below 0.1% by weight. In principle, any of the waxlike defoamer substances known from the prior art may be included. Examples of suitable waxlike compounds are bisamides, fatty alcohols, fatty acids, carboxylic acid esters of monohydric and polyhydric alcohols, and also paraffin waxes, or mixtures thereof. An alternative possibility is of course to use the silicone compounds which are known for this purpose.

Paraffin Waxes

Suitable paraffin waxes generally constitute a complex substance mixture without a defined melting point. The mixture is normally characterized by determining its melting range using differential thermal analysis (DTA), as described in The Analyst 87 (1962), 420, and/or its solidification point. The solidification point is the temperature at which the paraffin, by slow cooling, undergoes transition from the liquid to the solid state. Paraffins which are completely liquid at room temperature, i.e., those having a solidification point below 25° C., cannot be used in accordance with the invention. It is possible to use, for example, the paraffin wax mixtures known from EP 0309931 A1, made up for example of from 26% by weight to 49% by weight of microcrystalline paraffin wax having a solidification point of from 62° C. to 90° C., from 20% by weight to 49% by weight of hard paraffin with a solidification point of from 42° C. to 56° C., and from 2% by weight to 25% by weight of soft paraffin having a solidification point of from 35° C. to 40° C. It is preferred to use paraffins or paraffin mixtures which solidify in the range from 30°C. to 90°C. It needs to be borne in mind here that even paraffin wax mixtures which appear solid at room temperature may include various fractions of liquid paraffin. In the case of the paraffin waxes suitable for use in accordance with the invention, this liquid fraction is as low as possible and is preferably absent entirely. Accordingly, particularly preferred paraffin wax mixtures have a liquid fraction at 30° C. of less than 10% by weight, in particular from 2% by weight to 5% by weight, a liquid fraction at 40° C. of less than 30% by weight, preferably from 5% by weight to 25% by weight, and in particular from 5% by weight to 15% by weight, a liquid fraction at 60°C. of from 30% by weight to 60% by weight, in particular from 40% by weight to 55% by weight, a liquid fraction at 80° C. of from 80% by weight to 100% by weight, and a liquid fraction at 90° C. of 100% by weight. In the case of particularly preferred paraffin wax mixtures, the temperature at which a liquid fraction of 100% by weight of the paraffin wax is attained is still below 85° C., in particular at from 75° C. to 82° C. The paraffin waxes may comprise petrolatum, microcrystalline waxes, and hydrogenated or partially hydrogenated paraffin waxes.

Bisamides

Appropriate bisamide defoamers are those deriving from saturated fatty acids having from 12 to 22, preferably from 14 to 18 carbon atoms, and from alkylenediamines having from 2 to 7 carbon atoms. Suitable fatty acids are lauric, myristic, stearic, arachic and behenic acid and mixtures thereof, such as are obtainable from natural fats and/or hydrogenated oils, such as tallow or hydrogenated palm oil. Examples of suitable diamines are ethylenediamine, 1,3-propylenediamine, tetramethyl-enediamine, pentamethylenediamine, hexamethylene-diamine, p-phenylenediamine, and tolylenediamine. Preferred diamines are ethylenediamine and hexamethylenediamine. Particularly preferred bis-amides are bismyristoylethylenediamine, bispalmitoylethylenediamine, bisstearoylethylenediamine, and mixtures thereof, and also the corresponding derivatives of hexamethylenediamine.

Carboxylic Esters

Suitable carboxylic ester defoamers derive from carboxylic acids having from 12 to 28 carbon atoms. The esters in question particularly include those of behenic acid, stearic acid, hydroxystearic acid, oleic acid, palmitic acid, myristic acid and/or lauric acid. The alcohol moiety of the carboxylic ester comprises a monohydric or polyhydric alcohol having from 1 to 28 carbon atoms in the hydrocarbon chain. Examples of suitable alcohols are behenyl alcohol, arachidyl alcohol, cocoyl alcohol, 12-hydroxystearyl alcohol, oleyl alcohol, and lauryl alcohol, and also ethylene glycol, glycerol, polyvinyl alcohol, sucrose, erythritol, pentaerythritol, sorbitan and/or sorbitol. Preferred esters are those of ethylene glycol, glycerol, and sorbitan, the acid moiety of the ester being selected in particular from behenic acid, stearic acid, oleic acid, palmitic acid or myristic acid. Suitable esters of polyhydric alcohols are, for example, xylitol monopalmitate, pentaerythritol monostearate, glycerol monostearate, ethylene glycol monostearate, and sorbitan monostearate, sorbitan palmitate, sorbitan monolaurate, sorbitan dilaurate, sorbitan distearate, sorbitan dibehenate, sorbitan dioleate, and also mixed tallow alkyl sorbitan monoesters and diesters. Glycerol esters which can be used are the mono-, di-or triesters of glycerol and the carboxylic acids mentioned, with the monoesters or diesters being preferred. Glycerol monostearate, glycerol monooleate, glycerol monopalmitate, glycerol monobehenate, and glycerol distearate are examples thereof. Examples of suitable natural ester defoamers are beeswax, which consists principally of the esters $CH_3(CH_2)_{24}COO(CH_2)_{27}CH_3$ and $CH_3(CH_2)_{26}COO(CH_2)_{25}CH_3$, and carnauba wax, which is a mixture of carnaubic acid alkyl esters, often in combination with small fractions of free carnaubic acid, further long-chain acids, high molecular mass alcohols and hydrocarbons.

Carboxylic Acids

Suitable carboxylic acids as further defoamer compounds are particularly behenic acid, stearic acid, oleic acid, palmitic acid, myristic acid, and lauric acid, and also mixtures thereof, such as are obtainable from natural fats and/or optionally hydrogenated oils, such as tallow or hydrogenated palm oil. Preference is given to saturated fatty acids having from 12 to 22, in particular from 18 to 22, carbon atoms.

Fatty Substances

Suitable fatty alcohols as further defoamer compounds are the hydrogenated products of the fatty acids described. Furthermore, dialkyl ethers may additionally be present as defoamers. The ethers may be asymmetrical or else symmetrical in composition, i.e., contain two identical or different alkyl chains, preferably with from 8 to 18 carbon atoms. Typical examples are di-n-octyl ether, diisooctyl ether and di-n-stearyl ether; particularly suitable are dialkyl ethers having a melting point of more than 25° C., in particular more than 40° C. Further suitable defoamer compounds are fatty ketones, which may be obtained by the relevant methods of preparative organic chemistry. They are prepared, for example, starting from carboxylic acid magnesium salts, which are pyrolyzed at temperatures above 300° C. with elimination of carbon dioxide and water, in accordance for example with the German laid-open specification DE 2553900 A. Suitable fatty ketones are those prepared by pyrolyzing the magnesium salts of lauric acid, myristic acid, palmitic acid, palmitoleic acid, stearic acid, oleic acid, elaidic acid, petroselinic acid, arachic acid, gadoleic acid, behenic acid or erucic acid.

Fatty Acid Polyethylene Glycol Esters

Further suitable defoamers are fatty acid polyethylene glycol esters, which are obtained preferably by homogeneous base-catalyzed addition reaction of ethylene oxide with fatty acids. In particular, the addition reaction of ethylene oxide with the fatty acids takes place in the presence of alkanolamine catalysts. The use of alkanolamines, especially triethanolamine, leads to extremely selective ethoxylation of the fatty acids, especially where the aim is to prepare compounds with low degrees of ethoxylation. Within the group of the fatty acid polyethylene glycol esters, preference is given to those having a melting point of more than 25° C., in particular more than 40° C.

Carrier Materials

Within the group of the waxlike defoamers, particular preference is given to using the above-described paraffin waxes as sole waxlike defoamers or in a mixture with one of the other waxlike defoamers, the fraction of the paraffin waxes in the mixture accounting preferably for more than 50% by weight, based on the waxlike defoamer mixture. Where appropriate, the paraffin waxes may have been applied to carriers. Suitable carrier materials include all known inorganic and/or organic carrier materials. Examples of typical inorganic carrier materials are alkali metal carbonates, aluminosilicates, water-soluble phyllosilicates, alkali metal silicates, alkali metal sulfates, an example being sodium sulfate, and alkali metal phosphates. The alkali metal silicates preferably comprise a compound having an alkali metal oxide to $SiO_2$ molar ratio of from 1:1.5 to 1:3.5. The use of such silicates results in especially good particle properties; in particular, high abrasion stability and yet high dissolution rate in water. The aluminosilicates referred to as carrier materials include in particular the zeolites, examples being zeolite NaA and NaX. The compounds referred to as water-soluble phyllosilicates include, for example, amorphous or crystalline waterglass. It is also possible to use silicates which are in commerce under the designation AEROSIL® or SIPERNAT®. As organic carrier materials, suitable examples include film-forming polymers, examples being polyvinyl alcohols, polyvinylpyrrolidones, poly (meth)acrylates, polycarboxylates, cellulose derivatives, and starch. Cellulose ethers that may be used are, in particular, alkali metal carboxymethylcellulose, methylcellulose, ethylcellulose, hydroxyethylcellulose, and what are known as cellulose mixed ethers, examples being methylhydroxyethylcellulose and methylhydroxypropylcellulose, and also mixtures thereof. Particularly suitable mixtures are composed of sodium carboxymethylcellulose and methylcellulose, the carboxymethylcellulose usually having a degree of substitution of from 0.5 to 0.8 carboxymethyl groups per anhydroglucose unit and the methylcellulose having a degree of substitution of from 1.2 to 2 methyl groups per anhydroglucose unit. The mixtures preferably comprise alkali metal carboxymethylcellulose and nonionic cellulose ethers in weight proportions of from 80:20 to 40:60, in particular from 75:25 to 50:50. Another suitable carrier is natural starch, which is composed of amylose and amylopectin. Natural starch is starch such as is available as an extract from natural sources, for example, from rice, potatoes, corn, and wheat. Natural starch is a commercially customary product and as such is readily available. As carrier materials it is possible to use one or more of the compounds mentioned above, selected in particular from the group of the alkali metal carbonates, alkali metal sulfates, alkali metal phosphates, zeolites, water-soluble phyllosilicates, alkali metal silicates, polycarboxylates, cellulose ethers, polyacrylate/polymethacrylate, and starch. Particularly suitable mixtures are those of alkali metal carbonates, especially sodium carbonate, alkali metal silicates, especially sodium silicate, alkali metal sulfates, especially sodium sulfate, and zeolites.

Silicones

Suitable silicones are customary organopolysiloxanes which may contain finely divided silica, which in turn may also have been silanized. Such organopolysiloxanes are described, for example, in the European patent application EP 0496510 A1. Particularly preferred polydiorganosiloxanes are those which are known from the prior art. It is, however, also possible to use compounds crosslinked by way of siloxane, which the skilled worker knows by the name of silicone resins. In general, the polydiorganosiloxanes contain finely divided silica, which may also have been silanized. Dimethylpoly-siloxanes containing silica are especially suitable.

The polydiorganosiloxanes advantageously have a Brookfield viscosity at 25° C. in the range from 5 000 mPas to 30 000 mPas, in particular from 15 000 to 25 000 mPas. The silicones are preferably on carrier materials. Suitable carrier materials have already been described in connection with the paraffins. The carrier materials are generally present in amounts of from 40 to 90% by weight, preferably in amounts of from 45 to 75% by weight, based on defoamers.

Perfume Oils and Fragrances

As perfume oils and/or fragrances it is possible to use certain odorant compounds, examples being the synthetic products of the ester, ether, aldehyde, ketone, alcohol and hydrocarbon type. Odorant compounds of the ester type are, for example, benzyl acetate, phenoxyethyl isobutyrate, p-tert-butylcyclohexyl acetate, linalyl acetate, dimethylbenzylcarbinyl acetate, phenylethyl acetate, linalyl benzoate, benzyl formate, ethyl methylphenylglycinate, allyl cyclohexylpropionate, styrallyl propionate, and benzyl salicylate. The ethers include, for example, benzyl ethyl ether; the aldehydes include, for example, the linear alkanals having 8–18 carbon atoms, citral, citronellal, citronellyloxyacet-aldehyde, cyclamen aldehyde, hydroxycitronellal, lilial, and bourgeonal; the ketones include, for example, the ionones, α-isomethylionone and methyl cedryl ketone; the alcohols include anethole, citronellol, eugenol, geraniol, linalool, phenylethyl alcohol and terpineol; and the hydrocarbons include primarily the terpenes such as limonene and pinene. Preference, however, is given to the use of mixtures of different odorants, which together produce an appealing fragrance note. Such perfume oils may also contain natural odorant mixtures, such as are obtainable from plant sources, examples being pine oil, citrus oil, jasmine oil, patchouli oil, rose oil or ylang—ylang oil. Likewise suitable are clary sage oil, camomile oil, clove oil, balm oil, mint oil, cinnamon leaf oil, lime blossom oil, juniperberry oil, vetiver oil, olibanum oil, galbanum oil, and labdanum oil, and also orange blossom oil, nerol oil, orange-peel oil, and sandalwood oil.

The fragrances may be incorporated directly into the compositions of the invention; alternatively, it may be advantageous to apply the fragrances to carriers which intensify the adhesion of the perfume on the laundry and, by means of slower fragrance release, ensure long-lasting fragrance of the textiles. Materials which have become established as such carriers are, for example, cyclodextrins, it being possible in addition for the cyclodextrin-perfume complexes to be further coated with other auxiliaries.

Water-Soluble Inorganic Salts

Further suitable ingredients of the compositions are water-soluble inorganic salts such as bicarbonates, carbonates, amorphous silicates, standard waterglasses, which have no outstanding builder properties, or mixtures of these; use is made in particular of alkali metal carbonate and/or amorphous alkali metal silicate, especially sodium silicate having an $Na_2O:SiO_2$ molar ratio of from 1:1 to 1:4.5, preferably from 1:2 to 1:3.5. The sodium carbonate content of the end formulations is preferably up to 40% by weight, advantageously between 2 and 35% by weight. The sodium silicate (without particular builder properties) content of the compositions is generally up to 10% by weight and preferably between 1 and 8% by weight. If desired, the end formulations may additionally include inorganic salts as make-up or standardizing agents, such as sodium sulfate, for example, which is present preferably in amounts of from 0 to 10%, particularly from 1 to 5%, by weight, based on the composition.

Production of Laundry Detergent Compositions

The laundry detergent compositions obtainable using the additives of the invention can be prepared and used in the form of powders, extrudates, granules or agglomerates. They can be not only universal laundry detergents but also fine or color laundry detergents, optionally in the form of compacts or supercompacts. Such compositions may be produced using the appropriate processes known from the prior art. The compositions are preferably produced by mixing various particulate components containing laundry detergent ingredients. The particulate components can be produced by spray drying, simply mixing or complex granulation processes, for example fluidized bed granulation. It is preferable in this connection in particular that at least one surfactant-containing component be produced by fluidized bed granulation. It may further be particularly preferable for aqueous formulations of the alkali metal silicate and of the alkali metal carbonate to be spray dispensed in a drying means together with other laundry detergent ingredients, in which case granulation takes place as well as drying.

Spray Drying

The drying means into which the aqueous formulation is sprayed can be any desired drying apparatus. In a preferred form of the process, the drying is carried out as a spray drying in a drying tower. In this case, the aqueous formulations are exposed to a drying gas stream in a finely divided form in a known manner. Henkel's patent publications describe an embodiment of the spray drying process involving the use of superheated steam. The operating principle disclosed therein is hereby expressly also made part of the subject matter of the present inventive disclosure. Reference is made in particular to the following publications: DE 4030688 A1 and also the continuing publications as per DE 4204035 A1; DE 4204090 A1; DE 4206050 A1; DE 4206521 A1; DE 4206495 A1; DE 4208773 A1; DE 4209432 A1 and DE 4234376 A1. This process has already been presented in connection with the production of the defoamer granule.

Fluidized Bed Granulation

A particularly preferred way of producing the compositions is to subject the intermediate products to a fluidized bed granulation (SKET granulation) process. This is a preferably batchwise or continuous granulation with simultaneous drying. The intermediate products can be used not only in the dried state but also as an aqueous preparation. Preferred fluidized bed apparatuses have bottom plates having dimensions from 0.4 to 5 m. The granulation is preferably carried out at fluidizing air velocities in the range from 1 to 8 m/s. The granules are preferably discharged from the fluidized bed through a size classification process for the granules. The classification can be effected for example by means of a sieving device or through a countercurrent air stream (sifting air) which is controlled in such a way that only particles from a certain size are removed from the fluidized bed while smaller particles are retained in the fluidized bed. The incoming air is customarily composed of the heated or unheated sifting air and the heated bottom air. The bottom air temperature is between 80 and 400° C., preferably 90 and 350° C. The process is advantageously started by initially charging an initiating material, for example granules from an earlier experimental batch.

Press Agglomeration

In another variant, which is preferred when high bulk density compositions are to be obtained in particular, the mixtures are subsequently subjected to a compacting step, and further ingredients are not mixed into the compositions until after the compacting step. The compacting of the ingredients in a preferred embodiment of the invention takes place in a press agglomeration process. The press agglomeration process to which the solid premix (dried base detergent) is subjected can be realized in various apparatuses. Depending on the type of agglomerator used, a distinction is made between different press agglomeration processes. The four most frequent press agglomeration processes which are preferred in the framework of the present invention are extrusion, roll pressing or compacting, pelletizing and tableting, so that preferred press agglomeration processes for the purposes of the present invention are extrusion, roll compacting, pelletizing and tableting processes.

The processes all have in common that the premix is densified and plasticized under pressure and the individual particles are pressed together by reducing the porosity and adhere to each other. In all processes (with restrictions in the case of tableting) the molds can be heated to higher temperatures or cooled to remove the heat created by shearing forces.

All processes may employ one or more binders as densifying assistant. However, it should be made clear that the use of a plurality of different binders and mixtures of different binders is also always possible per se. A preferred embodiment of the invention utilizes a binder which is already completely present as a melt at not more than 130° C., preferably not more than 100° C., especially up to 90° C. The binder thus has to be selected according to process and process conditions or the process conditions, especially the process temperature, have to be conformed to the binder if a certain binder is desired.

The actual densifying process preferably takes place at processing temperatures which, at least in the densifying step, are at least equal to the temperature of the softening point, if not the temperature of the melting point, of the binder. In a preferred embodiment of the invention, the process temperature is significantly above the melting point or above the temperature at which the binder is present as a melt. But it is particularly preferable for the process temperature in the densifying step to be not more than 20° C. above the melting temperature or the upper limit of the melting range of the binder. True, it is technically perfectly possible to operate with still higher temperatures; but it has been found that a temperature difference of 20° C. to the melting temperature or to the softening temperature of the binder is generally perfectly sufficient and that still higher temperatures do not bring additional advantages. This is why it is particularly preferable—for energy reasons in particular—to operate above but as close as possible to the melting point or the upper temperature limit of the melting range of the binder. Such a temperature regime has the further advantage that even thermally sensitive raw materials, for example peroxy bleaches such as perborate and/or percarbonate, but also enzymes, can increasingly be processed without serious active-substance losses. The possibility of accurate temperature control of the binder especially in the decisive step of densifying, i.e., between the mixing and/or homogenizing of the premix and the shaping, provides a process control regime which is very favorable from an energy viewpoint and extremely benign for the heat-sensitive constituents of the premix, since the premix is exposed to the higher temperatures for a short time only. In preferred press agglomeration processes, the molding tools of the press agglomerator (the screw(s) of the extruder, the roll(s) of the roll compactor and the press roll(s) of the pellet press) have a temperature of not more than 150° C., preferably of not more than 100° C., especially not more than 75° C., and the process temperature is 30° C., especially not more than 20° C., above the melting temperature or the upper temperature limit of the melting range of the binder. The duration of the heating in the compression region of the press agglomerators is preferably not more than 2 minutes, especially in the range from 30 seconds to 1 minute.

Binders

Preferred binders for use alone or mixed with other binders are polyethylene glycols, 1,2-polypropylene glycols and also modified polyethylene glycols and polypropylene glycols. Modified polyalkylene glycols include especially the sulfates and/or the disulfates of polyethylene glycols or polypropylene glycols having a relative molecular mass between 600 and 12 000, especially between 1 000 and 4 000. A further group consists of mono-and/or disuccinates of polyalkylene glycols which in turn have relative molecular masses between 600 and 6 000, preferably between 1 000 and 4 000. For a more particular description of modified polyalkylene glycol ethers, reference is made to the disclosure of the international patent application WO 93/02176. For the purposes of this invention, polyethylene glycols include polymers prepared using not only ethylene glycol but also $C_3$–$C_5$ glycols and also glycerol and mixtures thereof as initiating molecules. The definition further comprehends ethoxylated derivatives such as trimethylolpropane with 5 to 30 EO. The preferred polyethylene glycols may have a linear or branched structure, in which case especially linear polyethylene glycols are preferred. The especially preferred polyethylene glycols include those having relative molecular masses between 2 000 and 12 000, advantageously around 4 000, and polyethylene glycols having relative molecular masses below 3 500 and above 5 000 can be used especially in combination with polyethylene glycols having a relative molecular mass of around 4 000 and such combinations may advantageously include more than 50% by weight, based on the total amount of the polyethylene glycols, of polyethylene glycols having a relative molecular mass between 3 500 and 5 000. Useful binders, however, also include polyethylene glycols which are present per se in the liquid state at room temperature and a pressure of 1 bar; this applies in particular to polyethylene glycol having a relative molecular mass of 200, 400 and 600. However, these liquid polyethylene glycols should only be used in a mixture with at least one further binder subject to the proviso that this mixture shall again meet the requirements of the invention, i.e., shall have a melting point or softening point of at least above 45° C. Useful binders similarly include low molecular weight polyvinylpyrrolidones and derivatives thereof having relative molecular masses of up to 30 000. Preference is given here to relative molecular mass ranges between 3 000 and 30 000, for example around 10 000. Polyvinylpyrrolidones are preferably used not as sole binders but in combination with others, especially with polyethylene glycols.

The densified stock preferably has a temperature not above 90° C. immediately upon exiting from the production apparatus, and temperatures between 35 and 85° C. are particularly preferred. It has been determined that exit temperatures from 40 to 80° C., for example up to 70° C., are particularly advantageous in the extrusion process in particular.

Extrusion

In a preferred embodiment, the laundry detergent composition of the invention is produced by an extrusion as described for example in the European patent EP 0486592 B1 or in the international patent applications WO 93/02176 and WO 94/09111 or WO 98/12299. A solid premix is pressed into the shape of the strand under pressure and, after exiting from the hole mold, is chopped by a cutter to the predeterminable pellet size. The homogeneous and solid premix contains a plasticizing and/or lubricating agent effective to cause the premix to plastically soften under the pressure or input of specific energy and become extrudable. Preferred plasticizing and/or lubricating agents are surfactants and/or polymers. For the actual extrusion process, the abovementioned patents and patent applications are hereby expressly incorporated herein by reference. Preferably the premix is supplied to preferably a planetary roll extruder or a twin-screw extruder with corotating or counterrotating screws, whose barrel and whose extruder-pelletizing die may be heated to the predetermined extrusion temperature. Under the shearing action of the extruder screws, the premix—under pressure, preferably at least 25 bar but possibly below this level at extremely high throughputs, depending on the apparatus used—is compacted, plasticated, extruded in the form of fine strands through the die plate in the extruder head and finally comminuted by means of a rotary chopping knife to give, preferably, approximately spherical to cylindrical pellet particles. The hole diameter in the die plate and the strand cutting length are tailored to the chosen pellet size. This makes it possible to produce pellets of a substantially uniformly predeterminable particle size, and the absolute particle sizes can be specifically conformed to the intended application. Particle diameters of not more than 0.8 cm are preferred in general. Important embodiments here provide for the production of uniform pellets in the millimeter range, for example in the range from 0.5 to 5 mm and especially in the range from about 0.8 to 3 mm. The length/diameter ratio of the chopped primary pellets is preferably in the range from about 1:1 to about 3:1. It is further preferable to feed the still plastic primary pellets to a further shaping step; here, edges on the raw extrudate are rounded off, so that ultimately extrudate particles which are spherical to substantially spherical are obtainable. If desired, small amounts of dry powder, preferably zeolite powder such as zeolite NaA powder, can be used in this stage. This shaping can take place in commercially available rounding equipment. It is important here to ensure that only small amounts of fines are produced in this stage. Drying, which is described as a preferred embodiment in the abovementioned prior art documents, is subsequently possible, but not absolutely necessary. It may in fact be preferable not to dry after the compacting step. Alternatively, extrusion/pressing operations may also be conducted in low-pressure extruders, in the Kahl press (from Amandus Kahl) or in a Bextruder from Bepex. The temperature in the transition region of the screw, of the predivider and of the die plate is preferably controlled in such a way that the melt temperature of the binder or the upper limit of the melting range of the binder is at least reached, but preferably exceeded. The duration of heating in the compression region of the extrusion stage is preferably below 2 minutes, especially in the range from 30 seconds to 1 minute.

Roll Compaction

The laundry detergent compositions of the present invention can also be produced by roll compaction. In roll compaction, the premix is metered in a specific manner between two rolls which are smooth or provided with depressions of defined shape and is milled between the two rolls under pressure to form a leaf-shaped compact, known as a flake. The rolls exert a high nip pressure on the premix, and as and when required may be additionally heated and/or cooled. The use of smooth rolls results in smooth, unstructured flake bands, while, by using structured rolls, it is possible to produce correspondingly structured flakes in which, for example, particular shapes of the subsequent laundry detergent particles may be predefined. Subsequently, the flake band is broken into smaller pieces by a chopping and comminuting operation and may thus be processed into granular particles which can be improved further by means of additional, conventional, surface treatment processes, especially into a substantially spherical shape. In the roll compaction process too, the temperature of the pressing tools, i.e., of the rolls, is preferably not more than 150° C., preferably not more than 100° C., especially not more than 75° C. Particularly preferred production processes involving roll compaction utilize process temperatures which are 10° C., especially not more than 5° C., above the melting temperature or the upper temperature limit of the melting range of the binder. It is further preferable here that the duration of heating in the compression region of the rolls which are smooth or provided with depressions of defined shape is not more than 2 minutes, especially in the range from 30 seconds to 1 minute.

Pelletization

The laundry detergent composition of the invention can also be produced by pelletization. Here, the premix is applied to a perforated surface and is plasticated and forced through the holes by means of a pressure-exerting structure. In the case of customary embodiments of pelletizing presses, the premix is pressure compacted, plasticated, forced through a perforated surface in the form of fine strands by a rotating roll and finally comminuted using a chopper to form granular particles. A wide variety of designs are conceivable in this connection for pressure roll and perforated die. For example, flat perforated plates are used, as are concave or convex annular dies, through which the material is pressed by means of one or more pressure rolls. In the case of the plate devices, the compression rolls may also be conical in shape; in the annular devices, dies and compression roll(s) may rotate in the same direction or in opposite directions. An apparatus suitable for conducting the process of the invention is described for example in the German laid-open specification DE 3816842 A1. The annular die press this document discloses comprises a rotating annular die, interspersed with compression channels, and at least one compression roll, which is in operative connection with the inner surface of said die and which presses the material supplied to the die chamber through the compression channels and into a material discharge region. In this apparatus, the annular die and compression roll may be driven in the same direction, thereby making it possible to achieve reduced shearing stress and thus a smaller increase in the temperature of the premix. With pelletizing it is of course likewise possible to operate with heatable or coolable rolls in order to bring the premix to a desired temperature. In pelletization too, the temperature of the pressing tools, i.e., of the press or compression rolls, is preferably not more than 150° C., preferably not more than 100° C., especially not more than 75° C. Particularly preferred production processes utilizing roll compaction utilize process temperatures which are 10° C., especially not more than 5° C., above the melting temperature or the upper temperature limit of the melting range of the binder.

EXAMPLES

Inventive Examples 1 to 12, Comparative Examples C1 to C4.

In a washing machine (Miele W 918), 3.5 kg of standard laundry and a towel (which had been pretreated by washing it twice with a universal laundry detergent) were washed in a main wash cycle at 90° C. Immediately before each test, 84 g of laundry detergent of the composition according to Table 1 were placed in the dispenser drawer. Following the wash cycle, the towel was dried at room temperature for 24 hours and then subjected to testing by a panel of 20 individuals. Each person awarded a score of between 1 and 4 (1 =harsh, 4 =very soft). The average gave the assessment for the products, which is also reported in Table 1.

TABLE 1

Laundry detergent composition and soft hand

| Composition/ performance | C1 | 1 | 2 | C2 | 3 | 4 | C3 | 5 |
|---|---|---|---|---|---|---|---|---|
| Sodium dodecyl-benzene-sulfonate | 5.0 | 5.0 | 5.0 | — | — | — | — | — |
| $C_{12/18}$ cocyl alcohol sulfate sodium salt | — | — | — | 10.0 | 10.0 | 10.0 | — | — |
| $C_{12/18}$ coconut fatty acid sodium salt | 2.0 | 2.0 | 2.0 | — | — | — | 3.0 | 3.0 |
| $C_{12/18}$ coconut fatty alcohol + 7EO | 3.0 | 3.0 | 3.0 | — | — | — | 7.0 | 7.0 |
| Zeolite A | 25.0 | 25.0 | 25.0 | 25.0 | 25.0 | 25.0 | 25.0 | 25.0 |
| Guar hydroxypropyl-trimethyl-ammonium chloride[1)] | — | 5.0 | 5.0 | — | 5.0 | 5.0 | — | 5.0 |
| Phyllosilicate[2)] | — | — | 5.0 | — | — | 4.0 | — | — |
| Polycarb-oxylate[3)] | 5.0 | 5.0 | 5.0 | 5.0 | 5.0 | 5.0 | 5.0 | 5.0 |
| Sodium carbonate | 15.0 | 15.0 | 15.0 | 15.0 | 15.0 | 15.0 | 15.0 | 15.0 |
| Sodium silicate | 5.0 | 5.0 | 5.0 | 5.0 | 5.0 | 5.0 | 5.0 | 5.0 |
| Enzymes[4)] | 0.8 | 0.8 | 0.8 | 0.8 | 0.8 | 0.8 | 0.8 | 0.8 |
| Paraffin/ silicone defoamer[5)] | 3.0 | 3.0 | 3.0 | 3.0 | 3.0 | 3.0 | 3.0 | 3.0 |
| PVP | 0.5 | 0.5 | 0.5 | 0.5 | 0.5 | 0.5 | 0.5 | 0.5 |
| Sodium sulfate | | | | to 100 | | | | |
| Hand rating | 1.1 | 2.4 | 2.8 | 1.0 | 1.8 | 2.2 | 1.0 | 1.5 |

| Composition/ performance | 6 | C4 | 7 | 8 | 9 | 10 | 11 | 12 |
|---|---|---|---|---|---|---|---|---|
| $C_{12/18}$ coconut fatty acid sodium salt | 3.0 | 3.0 | 3.0 | 3.0 | 3.0 | 3.0 | — | — |
| $C_{12/18}$ coconut fatty alcohol + 7EO | 7.0 | — | — | — | — | — | — | — |
| $C_{12/14}$ coconut alkyl glucoside | — | 7.0 | 7.0 | 7.0 | 7.0 | 7.0 | 10.0 | — |
| $C_{12/18}$ coconut amphoacetate sodium salt | — | — | — | — | — | — | — | 10.0 |
| Zeolite A | 25.0 | 25.0 | 25.0 | 25.0 | 25.0 | 25.0 | 25.0 | 25.0 |
| Guar hydroxy-propyl-trimethyl-ammonium chloride[1)] | 5.0 | — | 5.0 | 8.0 | 9.0 | 5.0 | 5.0 | 5.0 |
| Phyllosilicate[2)] | — | — | — | — | — | 5.0 | 5.0 | 5.0 |
| Polycarb-oxylate[3)] | 5.0 | 5.0 | 5.0 | 5.0 | 5.0 | 5.0 | 5.0 | 5.0 |
| Sodium carbonate | 15.0 | 15.0 | 15.0 | 15.0 | 15.0 | 15.0 | 15.0 | 15.0 |
| Sodium silicate | 5.0 | 5.0 | 5.0 | 5.0 | 5.0 | 5.0 | 5.0 | 5.0 |
| Enzymes[4)] | 0.8 | 0.8 | 0.8 | 0.8 | 0.8 | 0.8 | 0.8 | 0.8 |
| Paraffin/ silicone defoamer[5)] | 3.0 | 3.0 | 3.0 | 3.0 | 3.0 | 3.0 | 3.0 | 3.0 |

TABLE 1-continued

Laundry detergent composition and soft hand

| | | | | | | | | |
|---|---|---|---|---|---|---|---|---|
| PVP | 0.5 | 0.5 | 0.5 | 0.5 | 0.5 | 0.5 | 0.5 | 0.5 |
| Sodium sulfate | | | | to 100 | | | | |
| Hand rating | 2.0 | 1.5 | 2.7 | 3.2 | 2.6 | 2.0 | 3.5 | 3.7 |

[1)]Cosmedia ® Guar C 261;
[2)]Bentone ® EW;
[3)]Sokalan ® CP5;
[4)]Amylase/Protease/Lipase/Cellulase;
[5)]Dehydran ® 760

What is claimed is:

1. A detergent composition comprising:

(a) a surfactant selected from the group consisting of an anionic surfactant, a nonionic surfactant, an amphoteric surfactant, a zwitterionic surfactant, and mixtures thereof;

(b) a cationic polymer;

(c) a zeolite, and (d) a phyllosilicate.

2. The composition of claim 1 wherein the surfactant is present in the composition in an amount of from about 1 to 50% by weight, based on the weight of the composition.

3. The composition of claim 1 wherein the cationic polymer is present in the composition in an amount of from about 0.1 to 10% by weight, based on the weight of the composition.

4. The composition of claim 1 wherein the zeolite is present in the composition in an amount of from about 10 to 60% by weight, based on the weight of the composition.

5. The composition of claim 1 wherein the phyllosilicate is present in the composition in an amount of from about 1 to 10% by weight, based on the weight of the composition.

6. The composition of claim 1 wherein the surfactant is present in the composition in an amount of from about 5 to 25% by weight, based on the weight of the composition.

7. The composition of claim 1 wherein the cationic polymer is present in the composition in an amount of from about 1 to 8% by weight, based on the weight of the composition.

8. The composition of claim 1 wherein the zeolite is present in the composition in an amount of from about 15 to 25% by weight, based on the weight of the composition.

9. The composition of claim 1 wherein the phyllosilicate is present in the composition in an amount of from about 3 to 8% by weight, based on the weight of the composition.

10. A process for cleaning and softening textiles comprising contacting the textiles with a cleaning solution containing water and a detergent composition, the detergent composition comprising:

(a) a surfactant selected from the group consisting of an anionic surfactant, a nonionic surfactant, an amphoteric surfactant, a zwitterionic surfactant, and mixtures thereof;

(b) a cationic polymer;

(c) a zeolite, and (d) a phyllosilicate.

11. The process of claim 10 wherein the surfactant is present in the composition in an amount of from about 1 to 50% by weight, based on the weight of the composition.

12. The process of claim 10 wherein the cationic polymer is present in the composition in an amount of from about 0.1 to 10% by weight, based on the weight of the composition.

13. The process of claim 10 wherein the zeolite is present in the composition in an amount of from about 10 to 60% by weight, based on the weight of the composition.

14. The process of claim 10 wherein the phyllosilicate is present in the composition in an amount of from about 1 to 10% by weight, based on the weight of the composition.

15. The process of claim 10 wherein the surfactant is present in the composition in an amount of from about 5 to 25% by weight, based on the weight of the composition.

16. The process of claim 10 wherein the cationic polymer is present in the composition in an amount of from about 1 to 8% by weight, based on the weight of the composition.

17. The process of claim 10 wherein the zeolite is present in the composition in an amount of from about 20 to 40% by weight, based on the weight of the composition.

18. The process of claim 10 wherein the phyllosilicate is present in the composition in an amount of from about 3 to 8% by weight, based on the weight of the composition.

* * * * *